United States Patent [19]

Lewis et al.

[11] 3,963,098

[45] June 15, 1976

[54] POSITION MEASUREMENT APPARATUS

[75] Inventors: Arthur M. Lewis; Charles L. Winkler, both of Pittsburgh, Pa.

[73] Assignee: Westinghouse Electric Corporation, Pittsburgh, Pa.

[22] Filed: May 7, 1974

[21] Appl. No.: 467,698

[52] U.S. Cl. ..... 187/29 R; 340/21

[51] Int. Cl.[2] ..... B66B 3/02

[58] Field of Search ..... 187/29; 340/21

[56] References Cited

UNITED STATES PATENTS

| | | | |
|---|---|---|---|
| 3,414,088 | 12/1968 | Bruns et al. | 187/29 |
| 3,483,950 | 12/1969 | Simpson | 187/29 |

*Primary Examiner*—Gene Z. Rubinson
*Assistant Examiner*—W. E. Duncanson, Jr.
*Attorney, Agent, or Firm*—D. R. Lackey

[57] ABSTRACT

Position measurement apparatus which utilizes a digital code to accurately determine the position of a movable body along a travel path. The digital code is selected to provide, for any N consecutive bits of the code, a bit pattern which is unique. Indicia defining the code, and a reader, are arranged for relative motion in synchronism with movement of the movable body. Translating apparatus converts each combination of N consecutive bits read by the reader into an address defining the location of the movable body relative to the travel path. In a preferred embodiment, the digital code is a maximum length digital code, which is conveniently generated by a polynomial generator. The bit length of the code, which is equal to $2^N-1$, is selected according to the length of the travel path and the desired resolution.

25 Claims, 10 Drawing Figures

24
22
20
4X
X
BLANK
DN
MARK
UP
26
A B
C D
30"
30'
30
0 0 0 1
0 0 1 1
0 1 1 1
1 1 1 1
1 1 1 0
1 1 0 1
1 0 1 0
0 1 0 1
1 0 1 1
0 1 1 0
1 1 0 0
1 0 0 1
0 0 1 0
0 1 0 0
1 0 0 0
1 1 1 0
1 1 0 1
1 1 0 0
1 0 1 1
1 0 1 0
1 0 0 1
0 1 1 1
0 1 1 0
0 1 0 1
0 0 1 1
0 0 0 1
A B C D
DN UP
VERNIER
TAPE READER
TAPE
STORAGE REGISTER (READ UP ↑)
X3 X2 X1 X0 CYCLIC CODE (READ →)
BUILDING ADDRESS (BINARY)
TAPE READINGS
D2 D1 (GRAY CODE)

POSITION MEASUREMENT APPARATUS

BACKGROUND OF THE INVENTION

1. Field of the Invention

The invention relates in general to position measurement apparatus, and more specifically to apparatus for accurately measuring the position of a movable body, such an elevator car, along a travel path.

2. Description of the Prior Art the invention relates broadly to apparatus for accurately measuring the position of a movable body along a travel path. The invention is particularly well suited to measuring the position of an elevator car along its travel path, and it will be described in this context.

Electromechanical elevator control systems conventionally determine the position of the elevator car with an electromechanical device which is, in effect, a scaled down version of the associated elevator system. The car of the scaled model is driven in synchronism with the movement of the elevator car. An important advantage of the electromechanical floor selector, with it mechanical memory of floor position, is its retentive feature. If the electrical power should fail, the mechanical memory retains car position information. While the electromechanical device provides excellent results, it requires periodic maintenance due to the wear of its moving parts. Further, in order to provide the accuracy necessary to control high speed, high rise elevator systems, a relative large and therefore costly scaled model is required.

Solid state elevator control systems conventionally memorize car position in a binary counter. The binary count may be obtained by counting pulses in an up/-down counter, with a pulse being produced for each predetermined increment of car travel away from and back to a reference floor. Examples of systems which use counters and pulses are disclosed in U.S. Pat. Nos. 3,370,676, 3,425,515, 3,526,300, 3,589,474, 3,750,850, 3,773,146 and 3,777,855, and Canada Pat. No. 785,967.

Another arrangement for obtaining a binary count is to drive an encoder in synchronism with car movement. Examples of systems which use an encoder are disclosed in U.S. Pat. Nos. 3,590,335 and 3,743,055.

Still another arrangement for obtaining a binary count is to use coded perforated tape which is driven in synchronism with the elevator car and read by a stationary reader, or by using a stationary coded perforated tape which is read by a reader carried by the elevator car. U.S. Pat. Nos. 1,937,917 and RE 27,185 disclose the use of perforated tape and readers.

Systems which utilize a binary counter as a memory to retain a count indicating car position, lose track of the car in the event of power failure, as the content of the memory is destroyed. When electrical power returns, the memory is reinitialized by moving the elevator car to some preassigned known position, such as the bottom floor.

It would be desirable to provide new and improved position measurement apparatus for an elevator car which develops a count or address indicative of car position in the hoistway, and which regains car position information following a power failure without having to move the car to some preassigned floor. Further, it would be desirable to provide a system with this advantage which uses coded tape capable of determining car position to within about 0.5 inch, or less without resorting to a wide tape having a large plurality of parallel channels. For example, a tape having 15 parallel channels and a tape reader having 15 reader circuits would provide over 32,000 discrete positions in the hoistway, but a tape of this nature would not be practical.

SUMMARY OF THE INVENTION

Briefly, the present invention relates to a new and improved position measuring apparatus for measuring the position of a movable body along a travel path. The position measurement apparatus includes a digital code selected to provide a non-repeating pattern over any N consecutive bits thereof, over the length of the travel path. The digital code is also selected to determine the position of the movable body to the desired resolution. The maximum length cyclic digital codes, for example, which have a bit length of $2^N - 1$, provide a unique bit pattern over any N consecutive bits thereof. The value of N and thus the length of the maximum length digital code is selected according to the travel distance of the movable body and resolution desired. In an embodiment of the invention related to an elevator system, indicia in the hoistway, such as provided by a perforated steel tape, defines the digital code.

The N consecutive bits of the code which define an unique bit pattern at any code location may be read simultaneously, which requires a single channel tape and N readers. With this arrangement, the position of the movable body, such as an elevator car, would be available when power returns following a failure thereof, without moving the car. In a preferred embodiment of the invention, two vertical channels or columns are used on the tape with four readers. This combination accommodates any digital code length selected. In this preferred embodiment, the digital code is read one bit at a time and stored in a shift register to provide the N consecutive bits for translation to position of the movable body. The movable body need be moved only a distance of N bits on the tape to provide valid position information when power returns following the failure thereof.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENTS

The invention relates to position measuring apparatus for measuring the position of a movable body along a travel path, which apparatus is especially suitable for measuring the location of an elevator car in its hoistway, within a selected resolution. The position measuring apparatus uses a digital code which provides a unique bit pattern over any N consecutive bits thereof, over the travel length. In a preferred embodiment, the position measuring apparatus uses a maximum length digital code, which has a maximum code length of $2^N - 1$ bits, but any digital code which has the characteristic of providing an unique bit pattern over any N consecutive bits, over the travel path, may be used. The power N is selected according to the travel distance of the elevator car and desired resolution. For example, if the travel distance of the elevator car is 500 feet and it is desired to know the position of the elevator car to 0.4 inch, N may be selected to be 14. An N of 16 would provide 0.4 inch resolution for a travel path of 2000 feet.

The maximum length cycle digital code inherently provides an unique bit pattern over any N consecutive bits of the code. Thus, indicia disposed in the hoistway of a building, which may be 2000 feet tall, for example, which indicia defines a maximum length digital code developed by a 16 bit maximum length digital code generator, would provide an unique bit pattern over any 16 consecutive bits of the code. A tape reader on the elevator car reads at least 16 consecutive bits defined by the indicia disposed immediately adjacent the elevator car, and translating means converts the unique bit pattern into car location. Alternatively, the tape reader may be stationary, and the tape arranged to move in synchronism with the elevator car.

For purposes of example, a maximum length digital code having a bit length of $2^4 - 1$ will be described in detail. It will be apparent from this description how codes of greater length would be used.

Figure 1:
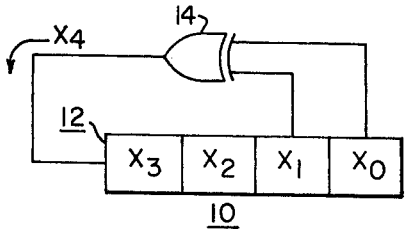
FIG. 1 is a diagrammatic representation of a maximum length digital code generator which provides a digital code used in an example illustrative of the invention.

FIG. 1 is a diagrammatic representation of a code generator 10 for generating a maximum length digital code having $2^4 - 1$, or 15 bits, which code provides an unique pattern over any four consecutive bits thereof. The maximum length digital codes are conveniently generated by a polynomial generator. The sign $\oplus$ in the polynomial selected to be generated represents addition in field modulo 2, which is equivalent to a Boolian exclusive OR. The code generator 10 is a polynomial generator which includes a shift register 12 having four stages labled $X_0$, $X_1$, $X_2$ and $X_3$. The outputs of stages $X_0$ and $X_1$ are exclusive OR'ed via a gate 14, and the output of gate 14, indicated as $X_4$, is connected to the input of stage $X_3$. A logical one is introduced into stage $X_3$ to start the code generator, and the shift register 12 is clocked at any desired rate. When the outputs of stages $X_0$ and $X_1$ are the same, i.e., both a logical one or both a logical zero, gate 14 will provide a logical zero output. When only one input is a logical one, the output of gate 14 is a logical one. Each clocking of the code generator 10 will provide a 4 - bit code pattern which is different for 15 consecutive clockings, and then the pattern repeats. These 15 readings at the outputs of stages $X_3$, $X_2$, $X_1$ and $X_0$ are shown in FIG. 3*A* starting with the logical one in stage $X_3$ to initiate the code generator. The code generator 10 satisfies the Polynomial $X^4 \oplus X \oplus 1 = 0$, where $X^4$ indicates the feedback bit and $X$ and 1 indicate the outputs of stages $X_1$ and $X_0$, respectively.

Figure 2:
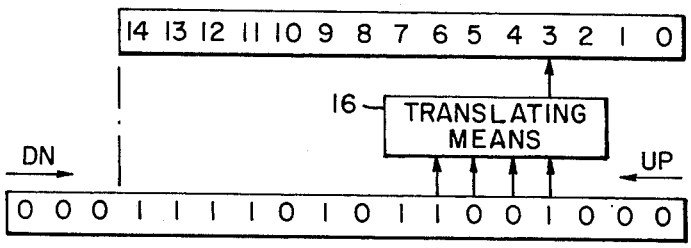
FIG. 2 illustrates the digital code generated by the code generator of FIG. 1 disposed along a travel path, with any N consecutive bits providing an unique bit pattern which may be translated to a location along the travel path.

The maximum length cyclic code generated by code generator 10 is illustrated in FIG. 2, disposed in a linear manner along the travel path of a movable body, with predetermined indicia, such as perforated steel tape, defining the bits of the code. Four consecutive bits may be read at a time, which corresponds to N consecutive bits, where N is used in the formula $2^N - 1$ for determining the bit length of the code. The bit pattern of any four consecutive bits is not repeated any other place within the code. Translating means 16, which includes readers for reading the indicia which defines the code, will determine the location of this bit pattern between the ends of the code. The translating means also relates this location within the code to a location or address along the travel path, and provides an output signal which indicates this location. While this output is diagrammatically illustrated in FIG. 2 as selecting an alpha-numeric character, the output may be a binary count or number.

The arrangement wherein N consecutive bits are read simultaneously, i.e., in parallel, from a single column of indicia defining the code, requires only a very narrow perforated tape, for example, and it has the advantage of being able to immediately regain car position information lost during a power failure, when power returns, without requiring the elevator car to move to some known floor position. It has the disadvantage, however, of requiring N reader circuits. Thus, an arrangement for a 2000 foot travel path having a 0.4 inch resolution would require 16 reader circuits.

Figure 3B:
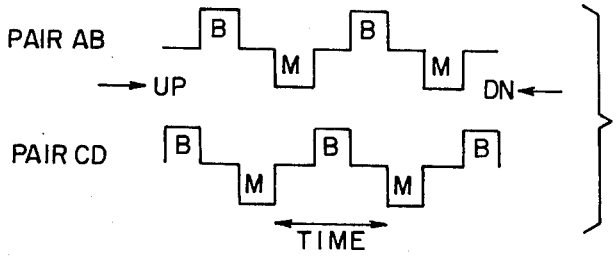
FIG. 3B is a graph which illustrates the manner in which car direction information is developed by the tape arrangement shown in FIG. 3A.
Figure 3A:
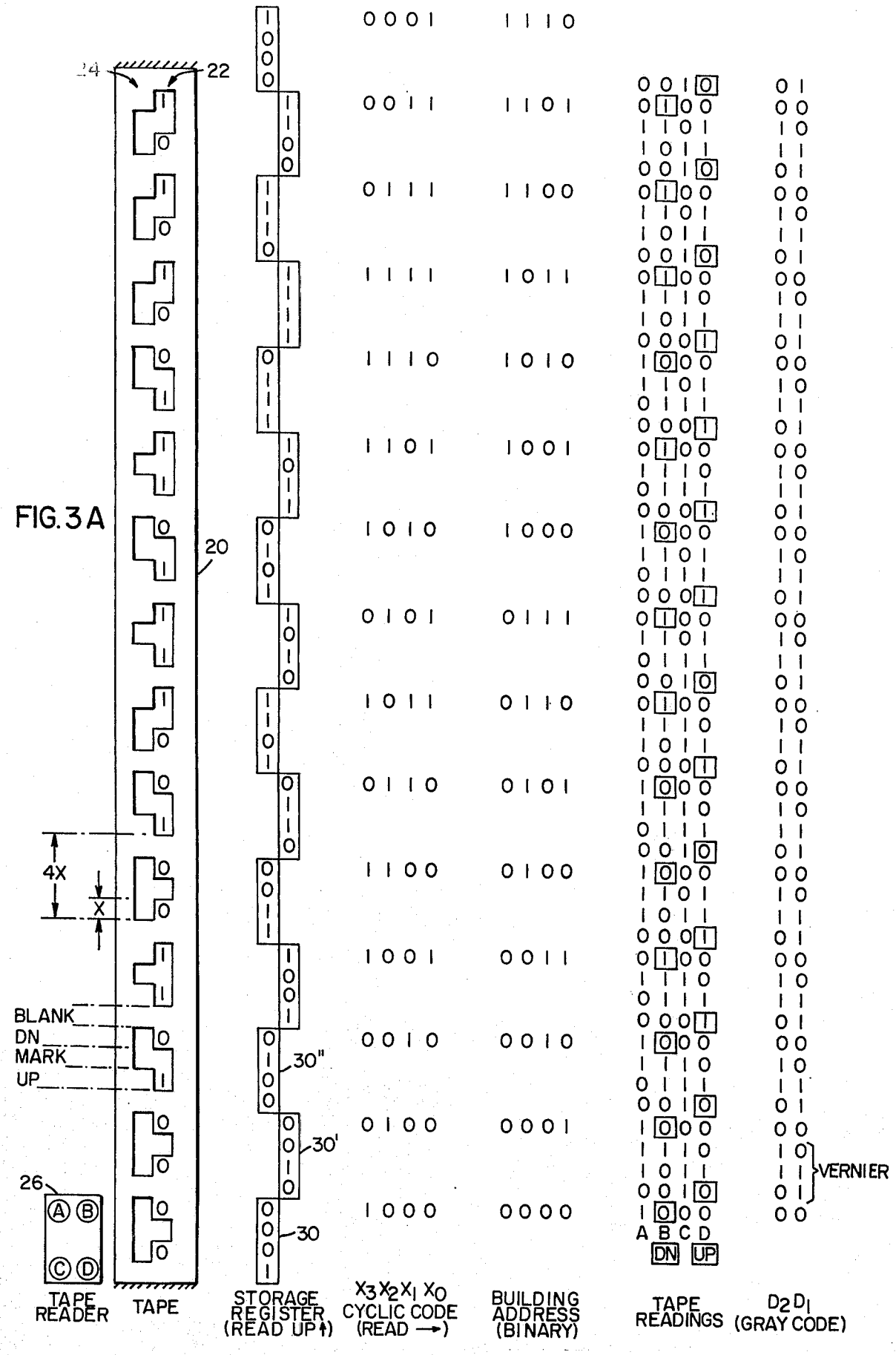
FIG. 3A is a perforated tape constructed and arranged according to a preferred embodiment of the invention, using the code generator and code shown in FIGS. 1 and 2 respectively.

FIGS. 3A and 3B illustrate a preferred embodiment of the invention which requires only four reader circuits regardless of the bit length of the digital code used. In general, a shift register having at least N stages and first and second ends is used to store the bits of the code read by the reader. The position code is read serially, i.e., one bit at a time. The indicia defines first and second like digital codes, the bits of which are interleaved along the travel path. The first and second codes are arranged relative to one another, and the readers arranged relative to the indicia, to update the shift register as the elevator car moves in either direction in the hoistway. For example, similar locations of the first and second codes may be offset from one another by the number of stages in the shift register. Thus, if the shift register has N stages, similar points of the two codes are offset from one another by N bits. When the elevator car is moving in an upward direction, the first digital code is read, introducing the bits of the first code into the first end of the shift register and shifting them toward the second end; and, when the elevator car is moving downwardly the second digital code is read, introducing the bits of the second digital code into the second end of the shift register and shifting toward the first end.

As hereinbefore stated, first and second digital codes are read, one of which provides information when the elevator car is moving in an upward direction, and the other of which provides information when the elevator car is moving in a downward direction. Two readers are provided for this function, one for deriving information from the first code and one for deriving information from the second code. Since the shift register is shifted in one direction when the elevator car is moving upwardly, and in the other direction when it is moving downwardly, the car travel direction must be known in order to properly set the shift direction of the shift register. This information is provided by adding a second column of information on the perforated tape, and by separating vertically adjacent bits of the code in a predetermined manner. First, vertically adjacent bits of code are separated by indicia in the two columns which indicate two logical ones, termed a mark, and then the next two bits of code are separated by indicia in the two columns which indicate two logical zeros, termed a blank. To distinguish code information from the marks and blanks, the second column includes indica defining a logical zero when the code information of the first column defines a logical one, and by adding indicia to the second column defining a logical one when the code of the first column is a logical zero. A pair of readers are required to read the first code, instead of a single reader, and a pair of readers are required to read the second code, instead of a single reader. These two pairs of readers also read the marks and blanks. The pair of readers for reading the second code when the elevator car is moving in a downward direction are identified as the AB tape readers, and the pair of readers for reading the first code when the elevator is moving upwardly are identified as the CD tape readers. The AB and CD tape readers are arranged such that when one pair is reading a mark or a blank, the other pair is reading the next bit of the cyclic code in the up or down direction. The travel direction of the car is decoded by observing the sequence in which the two pairs of readers alternately encounter marks and blanks.

Car position in the building is determined by comparing the N consecutive bits of code stored in the shift register with the digital code provided by a code generator to determine where in the code the N consecutive bits occur. The code is related to the travel path when the perforated tape or other indicia is manufactured. In a predetermined embodiment of the invention, a code generator is clocked at a very high rate, and a first binary counter is clocked at the same rate. The first binary counter is reset to zero each time the code generator starts with the code disposed on the tape at the start of the travel path, such as the bottom floor of an elevator installation. A second binary counter is arranged to be forced to the count of the first counter by an equality signal from a comparator which compares N consecutive bits of the shift register with N consecutive bits of the code provided by the code generator. The second counter, which contains a binary count indicative of the location of the elevator car in the building may be updated by the equality signal each time the bit pattern of the N consecutive bits in the shift register changes, or it may be clocked up by an up strobe or pulse received from the perforated tape each time a bit of the first code is read, and it may be clocked down by a down strobe or pulse received from the perforated tape each time a bit of the second code is read.

FIG. 3A illustrates a perforated tape 20, which tape may extend along the travel path of an elevator car and be read by a tape reader mounted on the elevator car; or the tape may be arranged such that it moves in synchronism with the car, with the tape reader being stationary. First and second vertical columns 22 and 24, respectively, of information are provided on the tape 20. A logical one is disposed in each of the first and second columns, which are arranged to be read simultaneously by a pair of readers, either pair AB or pair CD. The tape reader is shown generally at 26. The two logical ones are illustrated side by side, i.e., in the same row, in FIG. 3, and as hereinbefore stated, they are referred to collectively as a mark. The information from one of the digital codes, such as the first digital code, is disposed directly below the mark. If the code bit in the first column is a logical one, the second column has a logical zero, and vice versa. The information from the other digital code, such as the second digital code, is disposed directly above the mark. Logical zeros are disposed in the two columns directly above the information from the second digital code, which separates the down information of the second digital code from the up information of the first digital code. As illustrated in FIG. 3A, the vertical dimension of each bit of the first and second digital codes, as well as the vertical dimension of a mark and a blank, is equal to X, and thus the vertical dimension between bits of the same code is 4X. If X is equal to 0.1 inch, for example, the resolution of the position measuring apparatus will be 0.4 inch. As will be hereinafter explained, a 0.1 inch resolution may be obtained, if desired.

The logical ones and zeros of the first and second digital codes are illustrated in alpha-numeric form on the tape 20. FIG. 3A illustrates the bit pattern in a storage register 30, which pattern is responsive to the first digital code when the elevator car is moving in an upward direction, and to the second digital code when the elevator car is moving downwardly, to provide a single digital code in the shift register, regardless of travel direction, which is the same code as each of the first and second digital codes. The code passes through the shift register as the elevator car traverses its travel path and is thus the equivalent of having a tape in the hoistway with a single digital code thereon, and N readers for reading N consecutive bits of the code in parallel. The readings from the individual tape readers A, B, C and D of the tape reader 26 are illustrated for each standard increment X of movement of the elevator car. The code bits from the first and second codes appear in columns D and B respectively, and they are enclosed in a square. It is these code bits which are shifted into the shift register 30, depending upon travel direction.

As illustrated graphically in FIG. 3B, the mark/blank readings are successive in time as the elevator car moves in the shaft, and they alternate between the reader pairs. This information may be decoded to indicate travel direction, as listed in Table I:

TABLE I

| TRAVEL DIRECTION CODE | | |
|---|---|---|
| 1ST READING | 2ND READING | TRAVEL DIRECTION |
| AB — BLANK | CD — MARK | UP |
| AB — MARK | CD — BLANK | UP |
| CD — BLANK | AB — BLANK | UP |
| CD — MARK | AB — MARK | UP |
| AB — BLANK | CD — BLANK | DN |
| AB — MARK | CD — MARK | DN |
| CD — BLANK | AB — MARK | DN |
| CD — MARK | AB — BLANK | DN |

For example, as indicated in Table I, if reader pair AB reads a blank and then reader pair CD reads a mark, the car is traveling upwardly. On the other hand, if reader pair AB reads a blank and then reader pair CD reads a blank, the car is traveling downwardly. Decoding means, an example of which will be hereinafter described, provides a car direction signal in response to the marks and blank detected by the reader pairs AB and CD, which direction signal is used to set the shift direction of the shift register 30, as well as to set the direction of an up/down binary counter, which may be used to indicate car position in binary.

A code generator, such as code generator 10 shown in FIG. 1, is clocked at a very high rate, such as 100 khz providing the 4-bit cyclic code shown in FIG. 3A at the outputs of its four stages, at each clock pulse. A first binary counter is clocked at the same rate as the code generator, with the binary counter being set to zero when the cyclic code is providing an output which indicates the elevator car is reading the indicia adjacent thereto when it is standing at the bottom floor of the associated building. For example, when the cyclic code generator provides the code bit pattern 1000, the binary counter will output 0000, and when the code generator is clocked to 0100, the binary counter is clocked to 0001. A comparator compares the reading of the storage or shift register 30 with the output of the code generator, and it provides an equality signal when they are equal. A second binary counter is responsive to the first binary counter and to the equality signal, with the count of the first binary counter being loaded into the second binary counter when the equality signal is generated. The second binary counter thus contains the car position in binary, to the desired resolution. The loading of the count from the clocked first binary counter into the second or car position binary counter is initially delayed until the car has moved a distance sufficient to insure that the shift register has N valid code bits stored therein.

The second counter may be updated by the equality signal each time the storage register changes its bit pattern; or, the equality signal may be generated only periodically thereafter to insure proper synchronism, as desired. When the equality signal is generated only periodically, the car position counter may be indexed up, or down, as required, by the signals shown within the squares of the tape readings of FIG. 3A.

As illustrated in FIG. 3A, when the elevator car is at the bottom floor, the storage register will read 1000. When the elevator car moves upwardly, tape reader D introduces the signals into shift register 30 which are within the square. These signals are introduced into the lower end of the shift register 30 and they are shifted upwardly. Thus, tape reader D reads the logic zero when the car moves one increment X, the zero is loaded into the lower end of shift register 30, and all bits from the shift register are shifted upwardly one stage. The shift register reading indicated at 30' indicates the new reading of the shift register. The equality signal by the comparator will be issued when the code generator outputs 0100. When the car moves four more increments tape reader D reads a logic zero, which is loaded into the lower end of shift register 30, and the new reading of the shift register is indicated at 30''. If the elevator car changes its travel direction and starts to go down, tape reader B would read a logic zero after one increment of downward car movement and this logic zero would be introduced into the upper end of shift register 30. Everything in the shift register would shift downwardly by one stage, to provide the shift register reading shown at 30'. When the car moves four more increments in a downward direction, tape reader B would read another logic zero and shift register 30 would contain the initial reading of 1000.

Figure 4:
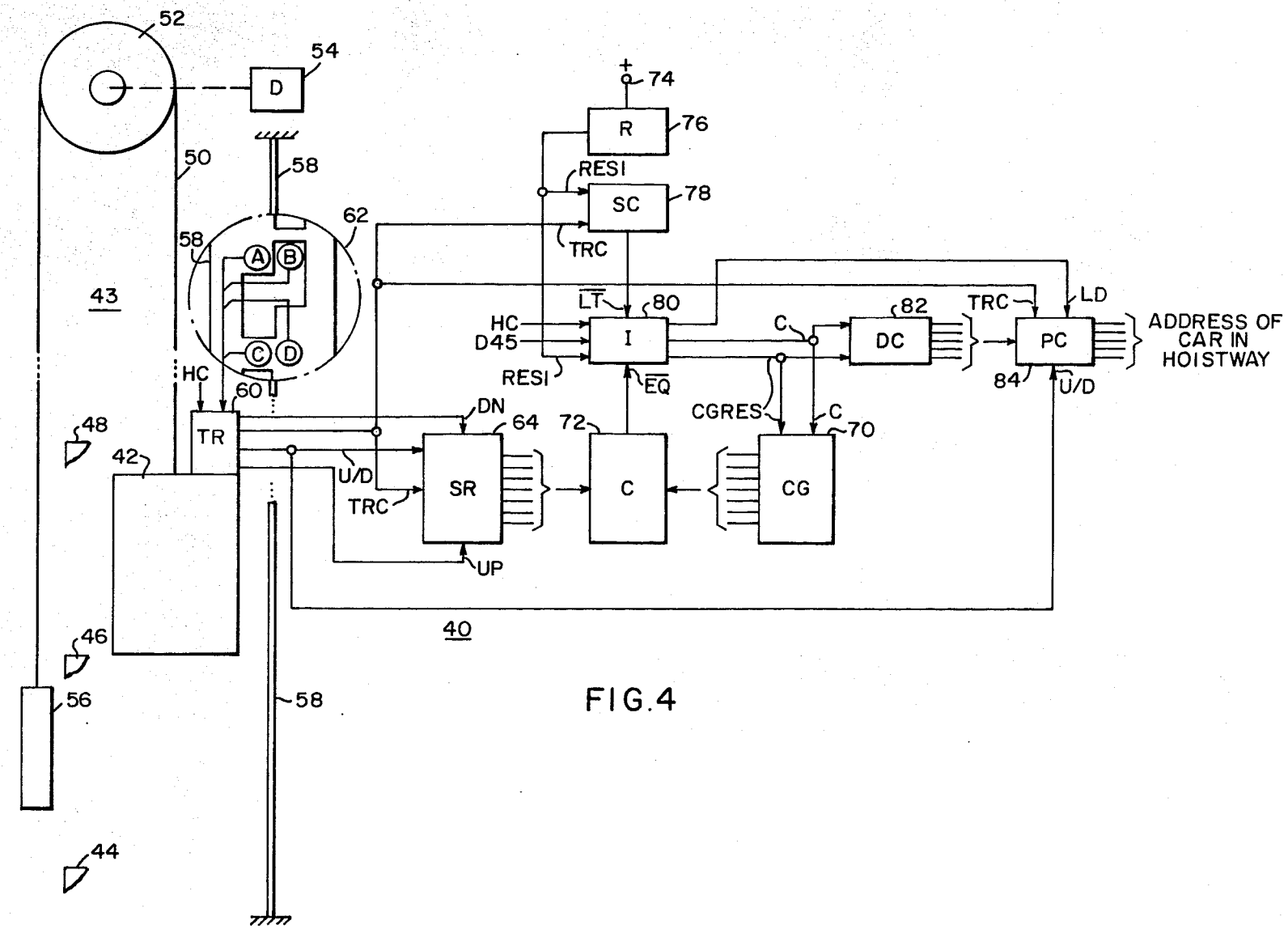
FIG. 4 is a block diagram of an elevator position measuring system constructed according to a preferred embodiment of the invention.

FIG. 4 is a block diagram of an elevator system 40 which includes position measurement apparatus constructed according to a preferred embodiment of the invention. Elevator system 40 includes an elevator car 42 mounted in a hoistway 43 for movement relative to a structure or building having a plurality of landings, which are indicated generally at 44, 46 and 48, which landings are served by the elevator car 42. Elevator car 42 is supported by a rope 50 which is reeved over a traction sheave 52 mounted on the shaft of a drive motor 54. A counterweight 56 is connected to the other end of rope 50. A perforated metallic tape 58 is vertically oriented in the hoistway 44 and disposed adjacent to the elevator car 42. The perforated metallic tape 58 may be similar to tape 20 shown in FIG. 3A, except with a longer maximum length digital code defined thereon.

A tape reader 60 is mounted on the elevator car, in a suitable location, such as on the top with the tape reader oriented such that it is adjacent to the tape 58. The code disposed on the tape 58 is read by four readers A, B, C and D, as shown in the magnified view 62 of the tape 58.

Figure 5:
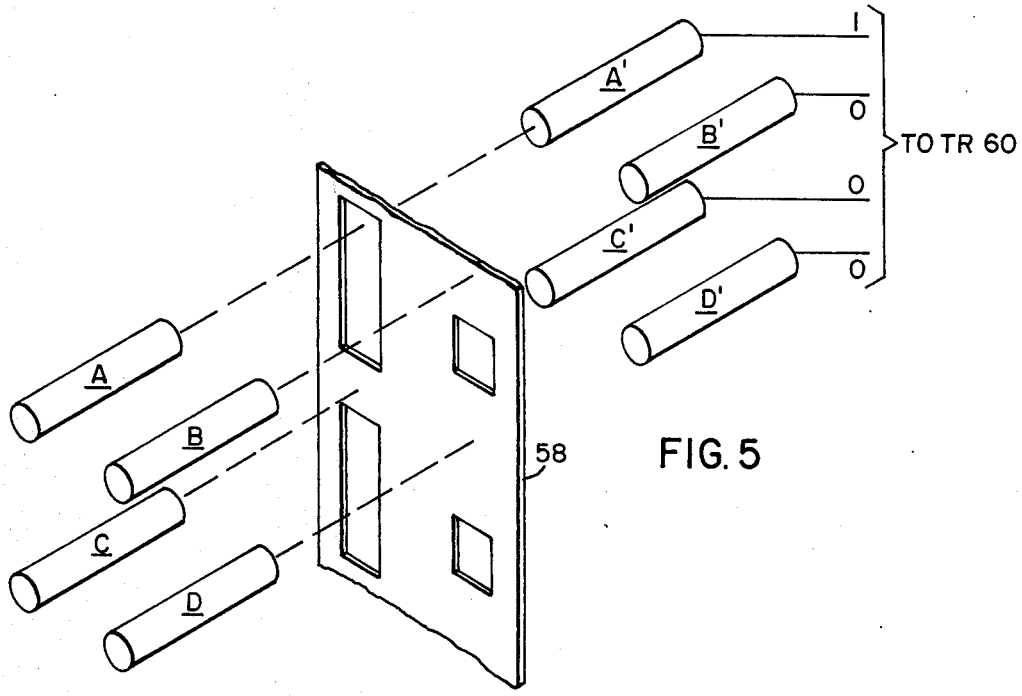
FIG. 5 is a diagrammatic representation of perforated tape and readers thereof which may be used to practice the teachings of the invention.

FIG. 5 illustrates a perspective view of tape 58 and a tape reader arrangement which may be used. Four sources A, B, C and D of electromagnetic radiation are spaced and directed to the tape 58 such that sources B and D are vertically aligned with the first vertical column of information on the tape, and vertically spaced apart by three increments X, as illustrated in FIG. 3A. Sources A and C are similarly aligned with the second vertical column of information on the tape and they are vertically spaced apart by three increments X. Receivers A', B', C' and D', which are responsive to the electromagnetic radiation of the sources A, B, C and D, respectively, are disposed on a side of the tape 58 which is opposite to the side on which the sources of radiation are located. When an opening of the tape 58 allows electromagnetic radiation from a source to strike its receiver, the receiver provides a signal indicative of a logical one. Otherwise, the receiver provides a signal indicative of a logical zero.

A shift register 64 is provided, similar to shift register 30, except having a number of stages sufficient to accommodate the code selected for the travel distance of the elevator car and the desired resolution. For purposes of standardization, a 16-bit code may be selected and used on all elevator installations, regardless of the travel distance of the elevator car, to provide a resolution of 0.4 inch for travel distances up to 2000 feet. Then, all of the perforated tapes may be made alike, and simply cutoff at the upper end to suit the travel distance. In line with this preferred standardization, the example shown in block form in FIG. 4, and the implementation thereof shown in FIGS. 6 through 9, will utilize a 16-bit digital code.

The tape reader 60 provides a signal U or D, depending upon whether the car is moving upwardly, or downwardly, respectively, which signals determine the shift direction of shift register 64. Tape reader 60 provides signal DN when the car is moving downwardly, each time reader B detects a down bit, the relative position of which is shown in FIG. 3A, and a signal UP when the car is traveling upwardly, each time tape reader D detects an up bit, the relative position of which is also shown in FIG. 3A. Signals UP and DN are the signals which are introduced into the shift register 64, as hereinbefore described relative to FIG. 3A. Tape reader 60 also produces a clock signal TRC which clocks the shift register each time a signal UP or a signal DN is provided, to shift the shift register one stage, shifting the new bit into the appropriate end of the shift register and shifting the bits already in the shift register in the appropriate direction. Tape reader 60 is responsive to a clock HC, which may run at any suitable frequency, such as 100 khz.

A 16-bit maximum length digital code generator 70 is reset by a reset signal CGRES and clocked by a clock signal C which is responsive to the clock HC. Clock HC runs all the time, while clock C only provides signals when it is necessary to clock the code generator. A comparator 72 compares 16 consecutive bits of the shift register 64 with 16 consecutive bits of the code generator 70, and when they are equal comparator 72 provides an equality signal $\overline{EQ}$, which then terminates the clock C.

When electrical control power, indicated by terminal 74, is initially applied to the elevator system 40, and each time the electrical power appears at terminal 74 following power failure or removal of power for any other reason, a reset circuit 76 provides a reset signal RES1. A start counter 78, in response to signal RES1, counts the TRC clock pulses from the tape reader 60, and when 16 pulses are counted it is known that the shift register 64 has a valid bit pattern stored therein. When the 16 pulses are counted, the start counter 78 provides a signal $\overline{LT}$.

An initialization circuit 80 is responsive to the reset signal RES1, to the clock HC, and to the signal $\overline{LT}$, providing the reset signal CGRES until signal $\overline{LT}$ goes low, providing the clock signals C until signal $\overline{EQ}$ goes low, and providing the signal LD when both signals $\overline{LT}$ and $\overline{EQ}$ are true.

A first 16-bit binary counter 82 is responsive to the signal CGRES and to the clock signal C. First binary counter 82 is reset simultaneously with the code generator 70, and it is clocked simultaneously with the code generator 70. The first binary counter 82 decodes the code generator reading at any instant to a binary address related to the hoistway. A second 16-bit binary counter 84 is forced to the output count of the first binary counter 82 when signal LD is true. This second binary counter 84 thus contains a binary count indicating car position in the hoistway. Binary counter 84 keeps track of car position in response to pulses TRC from the tape reader 60, counting up in response TRC pulses when signal U from tape reader 60 is true, and counting down in response to TRC pulses when signal D from tape reader 60 is true. The second binary counter 84 may be periodically forced to the count of the first binary counter 82, such as at each landing, to insure that the second binary counter does not get out of step with the true car position. This reinitialization may be responsive to any selected event, such as to a signal D45 applied to the initializationn circuit 80. Signal D45 is true each time the car doors are requested to close by the door circuits, and it remains true until the car doors are requested to open. Thus, the second binary counter is reset to the actual car position each time the elevator car doors are requested to close, such as before the elevator car makes a run.

Figure 6:
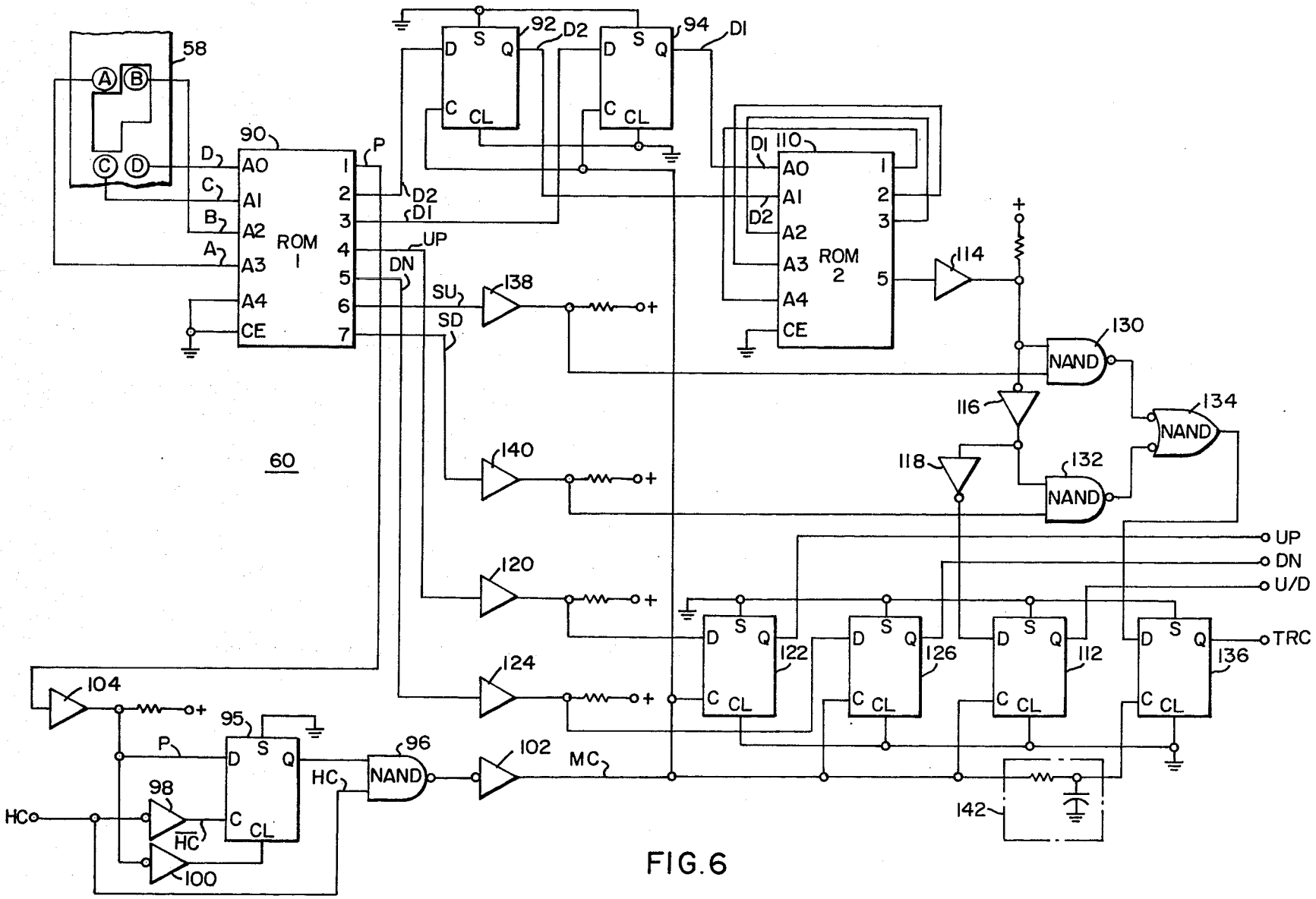
FIGS. 6, 7, 8 and 9 are schematic diagrams illustrating apparatus which may be used to perform the various functions illustrated in block form in FIG. 4.

FIG. 6 is a schematic diagram of a tape reader 60 which may be used for the tape reader 60 shown in block form in FIG. 4. Tape reader includes a read only memory 90, indicated as ROM1 in FIG. 6, which decodes the input signals from the four tape readers A, B, C and D. Memory 90, which may be Intersil's IM 5600, provides the outputs indicated in Table II in response to the different possible combinations of inputs from tape readers A, B, C, and D.

TABLE II

| | RϕM I | | | | | | | | | | |
|---|---|---|---|---|---|---|---|---|---|---|---|
| | INPUTS | | | | OUTPUTS | | | | | | |
| | A | B | C | D | P | D2 | D1 | UP | DN | SU | SD |
| * | 0 | 0 | 0 | 0 | 0 | ϕ | ϕ | ϕ | ϕ | 0 | 0 |
| | 0 | 0 | 0 | 1 | 1 | 0 | 1 | ϕ | ϕ | 0 | 0 |
| | 0 | 0 | 1 | 0 | 1 | 0 | 1 | ϕ | ϕ | 0 | 0 |
| * | 0 | 0 | 1 | 1 | 0 | ϕ | ϕ | ϕ | ϕ | 0 | 0 |
| | 0 | 1 | 0 | 0 | 1 | 0 | 0 | ϕ | 1 | 0 | 1 |
| * | 0 | 1 | 0 | 1 | 0 | ϕ | ϕ | ϕ | ϕ | 0 | 0 |
| * | 0 | 1 | 1 | 0 | 0 | ϕ | ϕ | ϕ | ϕ | 0 | 0 |
| | 0 | 1 | 1 | 1 | 1 | 1 | 1 | 1 | ϕ | 1 | 0 |
| | 1 | 0 | 0 | 0 | 1 | 0 | 0 | ϕ | 0 | 0 | 1 |
| * | 1 | 0 | 0 | 1 | 0 | ϕ | ϕ | ϕ | ϕ | 0 | 0 |
| * | 1 | 0 | 1 | 0 | 0 | ϕ | ϕ | ϕ | ϕ | 0 | 0 |
| | 1 | 0 | 1 | 1 | 1 | 1 | 1 | 0 | ϕ | 1 | 0 |
| * | 1 | 1 | 0 | 0 | 0 | ϕ | ϕ | ϕ | ϕ | 0 | 0 |
| | 1 | 1 | 0 | 1 | 1 | 1 | 0 | ϕ | ϕ | 0 | 0 |
| | 1 | 1 | 1 | 0 | 1 | 1 | 0 | ϕ | ϕ | 0 | 0 |
| * | 1 | 1 | 1 | 1 | 0 | ϕ | ϕ | ϕ | ϕ | 0 | 0 |

*invalid combinations

More specifically, output signal P is a parity signal which is true (logic one) when the input signals from the tape reader pairs provide valid combinations. Output signals D2 and D1 provide a gray code used to determine car travel direction. For example, as shown in FIG. 3 and in Table II, when tape reader pair CD reads a blank, signals D2 and D1 are zero, zero, respectively. When tape reader pair AB reads a blank, signals D2 and D1 are zero and one, respectively. When tape reader pair CD reads a mark, signals D2 and D1 are one and one, respectively, and when tape reader pair AB reads a mark, signals D2 and D1 are one and zero, respectively.

Signals D2D1 may also be used to provide a resolution of 1X, i.e., 0.1 inch in the example of FIG. 3A, by decoding the gray code to binary and adding two additional bits to the building address, adjacent the LSB thereof. For example, instead of the building address changing from 0000 to 0001, as indicated in FIG. 3A, the two additional bits, decoded from D2D1, operate as a vernier to provide the following addresses as the elevator car moves from address 0000 to 0001: 0000–00; 0000–01; 0000–10; 0000–11; 0001–00. Output signal UP is valid, providing a one or zero, each time tape reader D reads a one or zero respectively at an UP bit location on tape 58. Output signal DN is valid, providing a one or zero each time tape reader B reads a one or zero, respectively at a down bit location on the tape 58.

Output signal SU, which is used as a strobe, goes to logic one each time signal UP is valid, and output signal SD, which is also used as a strobe, goes to logic one each time signal DN is valid.

Output signals D2 and D1 from memory 90 are stored in D-type edge triggered flip-flops 92 and 94, respectively, which transfer the data at the D input thereof to their Q outputs on the positive edge of a clock pulse applied to its clock input. Flip-flops 92 and 94, as well as other D-type flip-flips shown in the drawings, may be RCA's 4013A, for example. The master clock MC clocks the flip-flops 92 and 94 when the tape readers A, B, C and D read a valid combination.

Master clock MC is provided by a D-type edge triggered flip-flop 95, a NAND gate 96, inverters 98, 100 and 102, a buffer 104, and an input HC connected to the high speed clock. The output P of memory 90 is connected to the D input of flip-flop 95 via the buffer 104. Buffer 104, as well as the other non-inverting buffers shown in FIG. 6, may be Texas Instrument's SN7407, for example. The output of buffer 104 is also connected to the CLEAR input of flip-flop 95 via inverter 100. Inverter 100, as well as the other inverters shown in the drawings, may be RCA's CD4009A, for example. The high speed clock HC is connected to the clock input of flip-flop 95 via inverter 98, and it is also connected directly to an input of NAND gate 96. NAND gate 96, as well as the other 2-input NAND gates shown in the drawings, may be RCA's CD4011A, for example. The Q output of flip-flop 95 is connected to the other input of NAND gate 96. The output of NAND gate 96 is inverted by inverter 102, and the output of inverter 102 provides the master clock signal MC.

When signal P is low, buffer 104 sets the Q output of flip-flop 95 to the logical zero level. When signal P goes high, indicating the readers A, B, C and D are reading a valid combination, output Q goes high on the next positive edge of $\overline{HC}$. A high Q output of flip-flop 95 enables NAND gate 96. An HC pulse goes through the enabled NAND gate 96, and inverter 102 provides the master clock signal MC. Clock MC is in phase with clock HC due to the double inversion provided by NAND gate 96 and inverter 102.

When the tape reader 60 detects a valid combination, the clock MC clocks the data at the D inputs of flip-flops 92 and 94 to their Q outputs. The Q outputs are decoded to provide car direction data. They may also be decoded to binary, as hereinbefore explained, to provide 1X resolution instead of 4X, if desired.

The decoder for decoding the D1 and D2 signals to provide direction information may be a read only memory 110, indicated as ROM2 in FIG. 6, which may be Intersil's IM 5600 connected as a sequential circuit. The stored D1 and D2 signals appearing at the Q outputs of flip-flops 94 and 92, respectively, are connected to the A0 and A1 inputs of memory 110, while outputs 1, 2 and 3 of memory 110 are connected to its A4, A3, and A2 inputs, respectively. Output terminal 5 provides a signal at the logical one level when the car direction is up, and a signal at the logical zero level when the car direction is down.

Table III indicates the possible inputs to memory 110, and the corresponding outputs.

TABLE III

RφM 2

| | UP INPUTS | | | | | OUTPUTS | | | | | DOWN INPUTS | | | | | OUTPUTS | | | |
|---|---|---|---|---|---|---|---|---|---|---|---|---|---|---|---|---|---|---|---|
| | A4 | A3 | A2 | D2 | D1 | 1 | 2 | 3 | 5 | | A4 | A3 | A2 | D2 | D1 | 1 | 2 | 3 | 5 |
| STABLE | 1 | 0 | 0 | 0 | 0 | 1 | 0 | 0 | 1 | STABLE | 0 | 0 | 0 | 0 | 0 | 0 | 0 | 0 | 0 |
| | 1 | 0 | 0 | 0 | 1 | 1 | 0 | 1 | 1 | | 0 | 0 | 0 | 0 | 1 | 1 | 0 | 0 | 0 |
| | 1 | 0 | 0 | 1 | 0 | 0 | 0 | 0 | 1 | | 0 | 0 | 0 | 1 | 0 | 0 | 1 | 0 | 0 |
| | 1 | 0 | 0 | 1 | 1 | 1 | 0 | 1 | 1 | | 0 | 0 | 0 | 1 | 1 | 0 | 1 | 1 | 0 |
| | 1 | 0 | 1 | 0 | 0 | 0 | 0 | 1 | 1 | | 0 | 0 | 1 | 0 | 0 | 0 | 0 | 0 | 0 |
| STABLE | 1 | 0 | 1 | 0 | 1 | 1 | 0 | 1 | 1 | STABLE | 0 | 0 | 1 | 0 | 1 | 0 | 0 | 1 | 0 |
| | 1 | 0 | 1 | 1 | 0 | 1 | 1 | 0 | 1 | | 0 | 0 | 1 | 1 | 0 | 0 | 0 | 0 | 0 |
| | 1 | 0 | 1 | 1 | 1 | 1 | 1 | 1 | 1 | | 0 | 0 | 1 | 1 | 1 | 1 | 0 | 1 | 0 |
| | 1 | 1 | 0 | 0 | 0 | 1 | 0 | 0 | 1 | | 0 | 1 | 0 | 0 | 0 | 1 | 1 | 0 | 0 |
| | 1 | 1 | 0 | 0 | 1 | 1 | 0 | 0 | 1 | | 0 | 1 | 0 | 0 | 1 | 0 | 1 | 1 | 0 |
| STABLE | 1 | 1 | 0 | 1 | 0 | 1 | 1 | 0 | 1 | STABLE | 0 | 1 | 0 | 1 | 0 | 0 | 1 | 0 | 0 |
| | 1 | 1 | 0 | 1 | 1 | 0 | 1 | 0 | 1 | | 0 | 1 | 0 | 1 | 1 | 0 | 1 | 1 | 0 |
| | 1 | 1 | 1 | 0 | 0 | 1 | 1 | 0 | 1 | | 1 | 1 | 1 | 0 | 0 | 0 | 0 | 1 | 0 |
| | 1 | 1 | 1 | 0 | 1 | 0 | 1 | 1 | 1 | | 0 | 1 | 1 | 0 | 1 | 0 | 0 | 1 | 0 |
| | 1 | 1 | 1 | 1 | 0 | 1 | 1 | 0 | 1 | | 0 | 1 | 1 | 1 | 0 | 1 | 1 | 1 | 0 |
| STABLE | 1 | 1 | 1 | 1 | 1 | 1 | 1 | 1 | 1 | STABLE | 0 | 1 | 1 | 1 | 1 | 0 | 1 | 1 | 0 |

For an example of how memory 110 functions, it will be assumed that all of the inputs to memory 110 are zeros, which condition is found in line 1 on the "down" side of Table III, and as indicated, this provides zeros at all of its outputs. If the elevator car moves and signals D2 and D1 change to 0 and 1, respectively, the A4, A3, A2, D2 and D1 inputs will then be 0, 0, 0, 0, 1, respectively, which combination is found in line 2 on the "down" side of the Table III, and as indicated these inputs provide outputs 1, 0, 0, and 0, at its outputs 1, 2, 3 and 5, respectively. This is not a stable position for memory 110, since the outputs 1, 2 and 3 are not the same as the inputs at A4, A3 and A2, respectively. The 1, 2 and 3 outputs are now 1, 0 and 0, respectively, and the 1, 0. 0, 0, 1 input sequence to memory 110 is located in line 2 on the "up" side of Table III. This input combination provides outputs 1, 0, 1 for outputs 1, 2 and 3, respectively, and again this is not a stable state for memory 110. The input combination is now 1, 0, 1, 0, 1, and, as indicated in the sixth line on the "up" side of Table III, this provides a stable state since outputs 1, 2 and 3 are 1, 0 and 1, respectively, the same as the A4, A3, and A2 inputs. Output 5 is at the logic 1 level, indicating the car has moved in the upward direction.

If the elevator car were now to move back to its previous position where the D2 and D1 signals are equal to 0 and 0, respectively, this would provide an input pattern of 1, 0, 1, 0, 0, which is found in line 5 on the "up" side of Table III. This is not a stable position, as the inputs are changed to 0, 0, 1, 0, 0. This input combination is found in line 5 on the down side of the table. Since the inputs are again changed, this is not a stable position. The new input combination is 0, 0, 0, 0, 0, which is found in line 1 on the down side of the table. This provides the same outputs as the inputs to the memory, a stable condition, and output 5 provides an output signal at the logical zero level, indicating that the car direction is down.

Output terminal 5 is connected to the D input of a D-type flip-flop 112 via a buffer 114 and inverters 116 and 118. When clock MC goes high the data at input terminal D is transferred to the Q output and to the U/D output terminal. If output 5 of memory 110 is at the logical one level, indicating up travel, the Q output of flip-flop 112 will be clocked to a logical one. If output 5 is at the logical zero level, indicating down travel, the Q output of flip-flop 112 will be clocked to a logical zero.

When tape reader D reads an up bit location on tape 58, the logical one or logical zero detected is applied, via buffer 120, to the D input of a D-type flip-flop 122. Clock MC clocks this input data to the Q output and to the output terminal UP.

When tape reader B reads a down bit location on tape 58, the logical one or logical zero detected is applied, via buffer 124, to the D input of a D-type flip-flop 126. Clock MC transfers this data to the Q output and to the output terminal DN.

A clock signal is provided at output terminal TRC each time an up bit is read on tape 58 by reader D when the car is traveling upwardly, and each time a down bit is read on tape 58 by reader B when the car is traveling in the down direction. These clock signals TRC are provided by NAND gates 130, 132 and 134, and by a D-type flip-flop 136. The strobe up signal SU is connected to an input of NAND gate 130 via a buffer 138, and the strobe down signal SD is connected to an input of NAND 132. Output 5 of memory 110, which indicates car direction, is connected to an input of NAND gate 130 via buffer 114, and to an input of NAND gate 132 via buffer 114 and inverter 116.

The outputs of NAND gates 130 and 132 are connected to inputs of NAND gate 134, and the output of NAND gate 134 is connected to the D input of flip-flop 136.

When the elevator car is going up, NAND gate 130 is enabled and NAND gate 132 is blocked, i.e., continuously providing a logical one output regardless of the logic level of the other input. The strobe signals SU and SD are both at the logic level zero. Thus, NAND gate 134 has two high inputs and it provides a logic zero output. Clocking of flip-flop 136 thus provides a logic zero at output terminal TRC. When an up bit is read by tape reader D, signal SU goes high, the output of NAND gate 130 goes low, and the output of NAND gate 134 goes high. The next MC clock pulse, which is delayed slightly by delay circuit 142 before being applied to flip-flop 136, clocks the logical one appearing at the D input of flip-flop 136 to the output terminal TRC. The delay circuit 142 insures that the MC clock has clocked all data, such as the UP, DN, and U/D signals, before the TRC clock pulse is generated, to prevent a race condition. When reader B reads a down bit on the tape and strobe SD goes high it has no circuit effect when the car is traveling up, since NAND gate 132 is blocked.

When the elevator car is going down, NAND gate 132 is enabled and NAND gate 130 is blocked. The strobe signals SU and SD are both at the logic zero level. Thus, NAND gate 134 has two high inputs and it provides a logic zero output. Clocking of flip-flop 136 thus provides a logic zero at output terminal TRC. When a down bit is read by reader B, signal SD goes high, the output of NAND gate 132 goes low, and the output of NAND gate 134 goes high. The next MC clock pulse clocks the high D input of flip-flop 136 to the output terminal TRC. When tape reader D reads an up bit on the tape and strobe SU goes high, it has no circuit effect when the car is traveling down, since NAND gate 130 is blocked.

Figure 7:
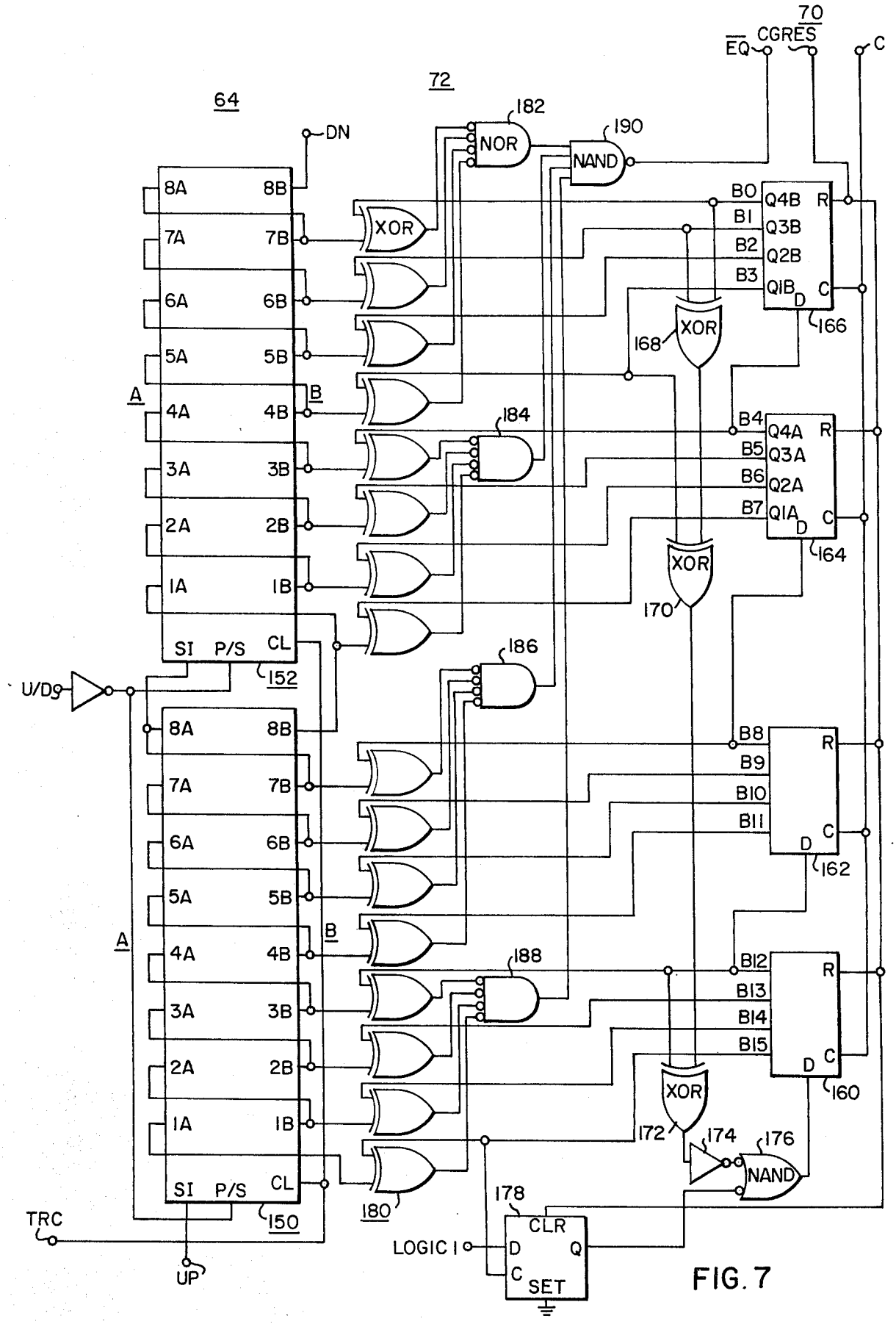

FIG. 7 is a schematic diagram of a shift register 64, a code generator 70 and a comparator 72, which may be used for the block functions shown in FIG. 4 having the same reference numerals. Shift register 64 is a shift-left/shift-right register, which includes two shift registers 150 and 152, each of which may be RCA's shift register CD4034A connected as illustrated. When the P/S inputs are low, the shift registers 150 and 152 will shift upwardly, as oriented in FIG. 7, and when the P/S inputs are high the shift registers will shift downwardly. The data from terminal UP of the tape reader 60 is connected to the input SI of register 150 and the data from terminal DN of tape reader 60 is connected to terminal 8B on the "B" side of the register. The register 64 is clocked by clock pulses TRC from the tape reader 60. When a total of 16 up or down bits have been clocked into shift register 64, its B outputs will contain 16 consecutive bits of the digital code, with these 16 stages of the shift register being connected to the comparator 72.

The code generator may be of any suitable construction as long as it is a maximum length digital code generator having a length $2^{16}-1$, with any 16 consecutive bits providing a unique pattern over the length of the code. A code generator described by the Polynomial $X^{16}\oplus X^{12}\oplus X^{3}\oplus X\oplus 1=0$ is shown, because it requires only three exclusive OR gates, but other circuit arrangements may be used. Polynomial code generators are described in the book entitled "Error Correcting Codes", second edition, by W. W. Peterson and E. J. Weldon, Jr., Copyright 1972 by the MIT Press. Four serial input/parallel output registers 160, 162, 164 and 166, such as may be provided by two of RCA's CD4015A dual 4-stage registers, are interconnected as illustrated, with the last output stage of one register connected to the data input terminal D of the next register. The reset inputs R are connected to input terminal CGRES and the clock inputs are connected to input terminal C. A high reset signal CGRES resets all four registers. The logic level present at the data input is transferred into the first stage, and all of the stages are shifted by one, at each positive transition of clock C. The B0 and B1 outputs of register 166 are exclusive OR'ed in a gate 168, and the output of gate 168 is exclusive OR'ed with the B3 output of register 166 in a gate 170. The output of gate 170 is exclusive OR'd with the B12 output of register 160 in a gate 172. The exclusive OR gates 168, 170 and 172 may be RCA's CD4030A, which is a quad exclusive-OR gate. The output of gate 172 is inverted in inverter 174 and applied to an input of a NAND gate 176. The Q output of a D-type flip-flop 178 is connected to the other input of NAND gate 176. The output of NAND gate 176 is connected to the D input of register 160.

Flip-flop 178 has its D input permanently tied to the logic one level, and its clock input is connected to output B15 of register 160. Its CLEAR input is connected to reset input terminal CGRES.

When reset signal CGRES goes high the outputs of registers 160, 162, 164 and 166 all go to zero and the Q output of flip-flop 178 goes to zero. Accordingly, the inputs to exclusive OR gate 172 are both zero and gate 172 outputs a logic zero level. Inverter 174 applies a logic 1 to an input of NAND gate 176, but the logic zero input to NAND gate 176 from flip-flop 178 forces the output of NAND gate 176 to a logic one. Thus, the first bit introduced into the first stage of register 160 on the first clock pulse C is a one bit. The one in this first stage of register 160 provides a one on the B15 output which clocks flip-flop 178 to provide a one at its Q output. NAND gate 176 thus has both inputs at the logic one level, and NAND gate 176 outputs a zero until the fourth clock pulse moves the initial one bit to the stage associated with output B12. At this point exclusive OR gate 172 has two different inputs, causing gate 172 to output a signal at the logic one level which is inverted to a zero by inverter 174. NAND gate 176 thus outputs a one which is introduced into register 160 on the next clock pulse. The operation of the code generator continues in this manner with flip-flop 178 enabling NAND gate 176 to produce ones and zeros according to the feedback network which includes the exclusive OR gates 168, 170 and 172 and the inverter 174. The bit pattern, over any consecutive 16 bits provided by the code generator never repeats over the 65,535 bits of the code.

Comparator 72 may be of any suitable arrangement, such as the one illustrated in FIG. 7, which uses 16 exclusive OR gates, shown generally at 180, which compare the 16 bits stored in the shift register 64 with the 16 bits of the rapidly clocked code generator. The outputs of the 16 exclusive OR gates 180 are applied to the inputs of NOR gates 182, 184, 186 and 188 which may be provided by two of RCA's CD4002A, which is a dual 4-input NOR gate. The outputs of NOR gates 182, 184, 186 and 188 are connected to the inputs of a 4-input NAND gate 190. The output of NAND gate 190 is connected to output terminal $\overline{EQ}$. When the bit pattern of shift register 64 is equal to the bit pattern provided by the code generator 70, the outputs of the 16 exclusive OR gates 180 will all be zero, the outputs of the four NOR gates 182, 184, 186 and 188 will all be at the logic one level, and the output of NAND gate 190 will go to zero. The zero at terminal $\overline{EQ}$ is a true equality signal which is utilized by the initialization circuit 80.

Figure 8:
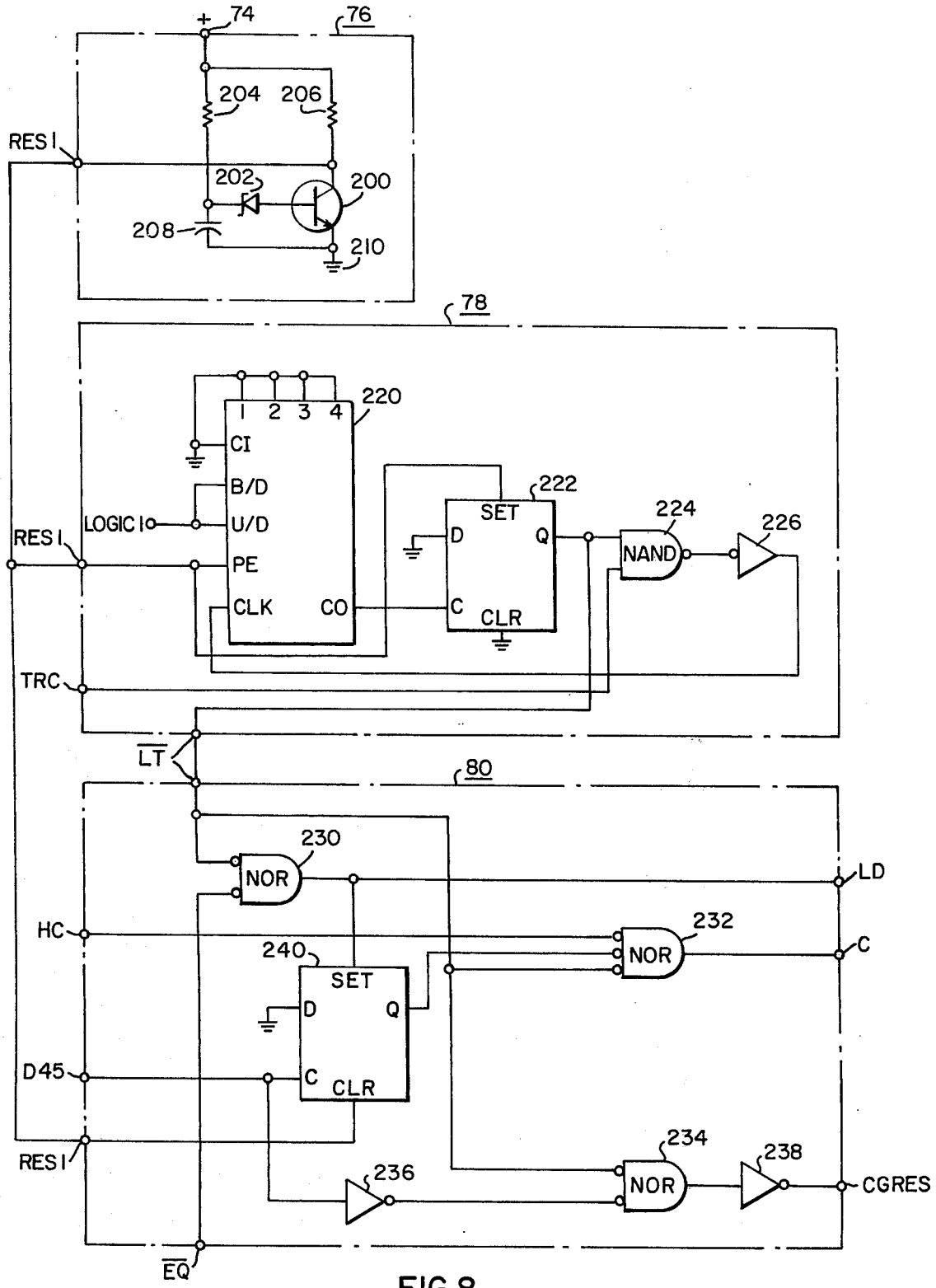

FIG. 8 is a schematic diagram of a reset circuit 76, a start counter circuit 78, and an initialization circuit 80 which may be used for the block functions having these reference numerals in FIG. 4. The reset circuit 76 is connected at terminal 74 to be responsive to the power supply for the elevator system. Circuit 76 includes an NPN transistor 200, a Zener diode 202, resistors 204 and 206, and a capacitor 208. Transistor 200 has its collector electrode connected to terminal 74 via resistor 206, and its emitter electrode is connected to ground 210. Resistor 204 and capacitor 208 are serially connected from terminal 74 to ground 210, and the base of the transistor 200 is connected to the junction between resistor 204 and capacitor 208 via the Zener diode 202. Zener diode 202 is poled to block current flow into the base electrode until the capacitor 208 charges to the breakdown voltage level of the Zener diode. When the electrical power is removed and then returns, the collector of transistor 200 and thus output terminal RES1 is high until capacitor 208 charges to the breakdown voltage of Zener diode 202. The values of resistor 204 and capacitor 208 are selected to provide a true signal at terminal RES1 for about 200 milliseconds. When Zener diode 202 conducts, transistor 200 is turned on, connecting terminal RES1 to ground 210.

The start counter circuit 78 includes a 4 stage presettable counter 220, such as RCA's CD4029A, a D-type flip-flop 222, a NAND gate 224, and an inverter 226. The four jam inputs 1, 2, 3 and 4 and carry input CI are connected to ground, the B/D and U/D inputs are tied to the logic one level, to cause the counters to count up in binary, and the preset enable input PE is connected to receive reset signal RES1 from reset circuit 76. The clock input CLK of counter 220 is connected to receive the TRC clock pulses from tape reader 60 via NAND gate 224 and inverter 226. As hereinbefore described, a TRC clock pulse is provided each time an up bit is read on the tape when the car is traveling in the upward direction, and each time a down bit is read on the tape when the car is traveling in the downward direction. The carry output CO of counter 220 is connected to the clock input of flip-flop 222. The D and CLEAR inputs of flip-flop 222 are connected to ground, the SET input is connected to receive the reset signal RES1, and the Q output is connected to an input of NAND gate 224.

When reset signal RES1 goes high at power turn-on it sets counter 220 to zero and it sets flip-flop 222 to provide a one at its Q output. NAND gate 224 is thus enabled and the TRC clock pulses are applied to the clock input of counter 220. When the elevator car moves, in either direction, such that 16 bits of code are read, providing 16 TRC pulses, the carry out output CO of counter 220 will go high and flip-flop 222 will clock the low D input to the Q output, blocking NAND gate 224 and providing a true signal $\overline{LT}$ at output terminal $\overline{LT}$.

The initialization circuit 80 includes NOR gates 230, 232 and 234, inverters 236 and 238, and a D-type flip-flop 240. NOR gate 230 has its two inputs connected to receive signal $\overline{LT}$ from start counter 78, and to receive the equality signal $\overline{EQ}$ from comparator 72. The output of NOR gate 230 is connected to the set input of flip-flop 240 and to the output terminal LD. The D input of flip-flop 240 is connected to ground, its C input is connected to input terminal D45, its CLEAR input is connected to receive reset signal RES1, and its Q output is connected to one of the three inputs of NOR gate 232. NOR gate 232 has its other two inputs connected to receive the clock HC and the signal $\overline{LT}$ from the start counter 78, and its output is connected to output terminal C.

NOR gate 234 has one of its two inputs connected to receive the signal $\overline{LT}$, and its other input is connected to input terminal D45 via inverter 236. The output of NOR gate 234 is connected to output terminal CGRES via inverter 238.

When electrical power first appears, input terminal LT is high which provides a high reset signal CGRES signal via NOR gate 234 and inverter 238, resetting the code generator 70 and the decoding counter 82. Signal D45 goes high when the doors are requested to close, and it remains high until the doors are requested to open. The high D45 signal clocks flip-flop 240 to provide a low Q output. When signal $\overline{LT}$ goes low NOR gate 234 provides a high output which is inverted by inverter 238 to remove the high reset signal CGRES from the code generator 70 and the decoding counter 82, and it enables NOR gate 232 to pass the high speed clock pulses HC to output terminal C. The code generator 70 and decoding counter 82 are then clocked in synchronism by clock C until the code generator reaches the code pattern stored in shift register 64, at which time comparator 72 provides a low $\overline{EQ}$ signal. The output of NOR gate 230 then goes high, setting the Q output of flip-flop 240 to a one which blocks any further clock pulses from reaching the output terminal C. The high output from NOR gate 230 also provides a true LD signal, which loads the count of counter 82 into the car position counter 84. The true car position is thus stored in counter 84, which then follows the movement of the car via the U or D pulses from the tape reader 60.

The position counter 84 should remain synchronized with the actual car position, but to insure that they stay synchronized, the initialization procedure just described may be periodically forced during normal system operation. As illustrated in FIG. 8, this reinitialization may occur each time signal D45 goes low when the car doors are requested to open. This low D45 signal forces output terminal CGRES high to reset the code generator 70 and decoding counter 82. When signal D45 goes high to request door closure, flip-flop 240 is clocked to provide a low Q output which enables NOR gate 232 to again pass the clock pulses HC to output terminal C. When the code generator is clocked to the bit pattern stored in the shift register 64, the input terminal $\overline{EQ}$ goes low, the output of NOR gate 230 goes high to set flip-flop 240 and block NOR gate 232, and signal LD goes high to load the count of the counter 82 into the car position counter 84.

Figure 9:
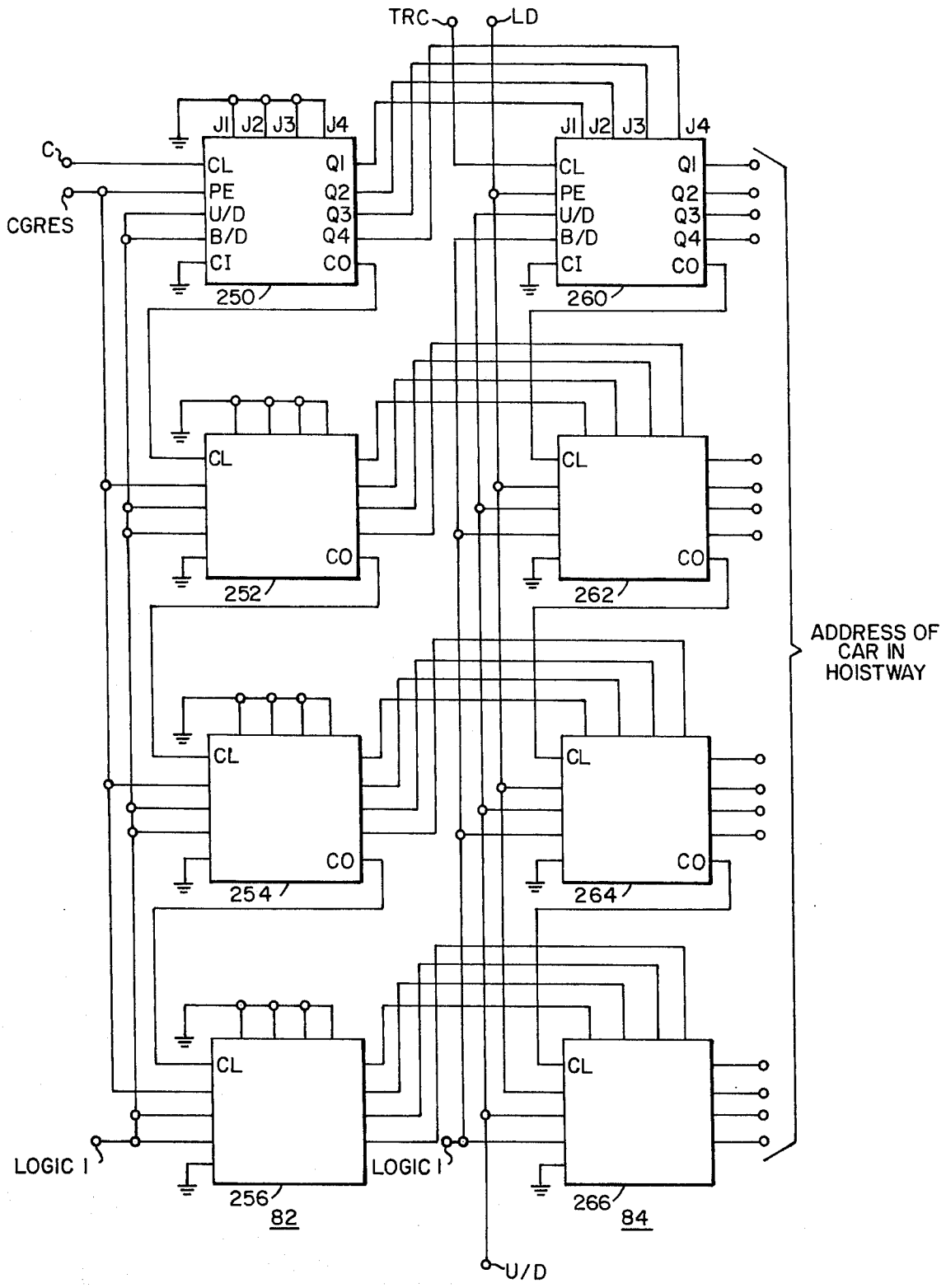

FIG. 9 is a schematic diagram of a decoding counter 82 and a position counter 84 which may be used for the functions shown in block form in FIG. 4 having these reference numerals. The decoding counter 82 is a binary counter which is reset with the code generator 70 and clocked therewith until the code generator reaches the position in the code identified by the bit pattern stored in shift register 64.

Counter 82 includes four 4-stage counters 250, 252, 254 and 256, such as RCA's CD4029A. Counter 250 has its jam inputs J1, J2, J3 and J4 connected to ground, its clock input CL connected to receive clock pulses C from the initialization circuit 80, its preset enable input PE is connected to receive a reset signal CGRES from the initialization circuit 80, its U/D and B/D inputs are tied to the logic one level to cause the counter to count up in binary, its carry in input CI is grounded, its carry out output CO is connected to clock input CL of counter 252, and its outputs Q1, Q2, Q3 and Q4 are connected to the jam inputs of a counter in the car position counter 84. Counter 252 is connected in a manner similar to counter 250, except its clock input CL is connected to the carry out output CO of counter 250, and its carry out output CO is connected to the clock input CL of counter 254. Counter 254 is connected in a manner similar to counter 252, with its carry out output CO connected to the clock input CL of counter 256. Counter 256 is connected in a manner similar to counter 254, except its carry out output CO is unconnected.

The position counter 84 includes four 4-stage counters, which also may be RCA's CD4029A. The jam inputs J1, J2, J3 and J4 of counter 260 are connected to the Q1, Q2, Q3 and Q4 outputs, respectively of counter 250. Its clock input CL is connected to receive the TRC clock signals from tape reader 60, its preset enable input is connected to receive signal LD from the initialization circuit 80, its U/D input is connected to receive the U/D signal from tape reader 60, its B/D input is tied to the logic one level, and the carry in input CI is grounded.

Counter 262 is connected in a manner similar to counter 260, except the clock input CL is connected to the CO output of counter 260 instead of the TRC clock signal, and its carry out output CO is connected to the clock input CL of the next counter 264. Counters 264 and 266 are connected in a manner similar to counter 262. The Q1, Q2, Q3 and Q4 outputs of counters 260, 262, 264 and 266 provide a 16 bit binary word which is the hoistway address of the location of the elevator car.

In summary, there has been disclosed new and improved position measurement apparatus, which is especially suitable for use in an elevator system, which utilizes indicia disposed in the hoistway, such as a perforated steel tape, to determine car position. The indicia defines a maximum length digital code, with the bit length of the code being selected according to the resolution desired and the length of the car travel path. The bit length of the code is $2^N - 1$, and it provides a nonrepetitive bit pattern over any N consecutive bits of the code. Thus, a single row of indicia may be read by N readers, or, as disclosed in a preferred embodiment of the invention, two rows of indicia may be read by four readers for any length code. The elevator car, following a power failure and return of power need at most move only a distance sufficient to read in N bits of code, before the car position will again be available to the supervisory control. The continuous, accurate information as to car position also enables the associated elevator control to be simplified, since auxiliary apparatus, such as hatch transducers, re-leveling contacts and slowdown cams may be eliminated. It also makes it practical to control car position directly, instead of using speed control.

We claim as our invention:

1. Position measurement apparatus for determining the position of a movable member along a travel path, comprising:

a plurality of indicia, said indicia defining the bits of a first digital code, sensing means responsive to said indicia, said sensing means and said indicia being arranged for relative movement responsive to movement of the movable member, said indicia defining a serial code which has a non-repeating bit pattern over any N consecutive bits thereof, said sensing means providing signals indicative of N consecutive bits of the first digital code defined by said indicia, providing an unique combination of N signals each time the next bit of the code is sensed by said sensing means, and translating means responsive to the signals provided by said sensing means, said translating means determining the position in the first digital code of the N consecutive bits indicated by the signals from said sensing means, and the location in the travel path where the indicia defines the N consecutive bits.

2. Position measurement apparatus for determining the position of a movable member along a travel path, comprising:

a plurality of indicia, said indicia defining the bits of a first digital code, sensing means responsive to said indicia, said sensing means and said indicia being arranged for relative movement responsive to movement of the movable member, said indicia having a non-repeating bit pattern over any N consecutive bits thereof, said sensing means providing signals indicative of N consecutive bits of the first digital code defined by said indicia, translating means responsive to the signals provided by said sensing means, said translating means determining the position in the first digital code of the N consecutive bits indicated by the signals from said sensing means, and the location in the travel path where the indicia defines the N consecutive bits, said translating means including code generator means, first and second counter means, and comparator means, means clocking said code generator means at a predetermined rate to provide the digital code defined by the indicia, and means clocking said first counter means in synchronism with said code generator means to provide an output count from said first digital counter means which indicates where the code being produced at any instant by the code generator means is located relative to the start and finish of the digital code, said comparator means providing an equality signal when the code generator is at the location of the digital code indicated by the signal from the sensing means, said second counter means being forced to the count of the first counter means when the equality signal is provided by said comparator means.

3. Position measurement apparatus for determining the position of a movable member along a travel path, comprising:

a plurality of indicia, said indicia defining the bits of a first digital code, sensing means responsive to said indicia, said sensing means and said indicia being arranged for relative movement responsive to movement of the movable member, said indicia having a non-repeating bit pattern over any N consecutive bits thereof, said sensing means providing signals indicative of N consecutive bits of the first digital code defined by said indicia, and translating means responsive to the signals provided by said sensing means, said translating means determining the position in the first digital code of the N consecutive bits indicated by the signals from said sensing means, and the location in the travel path where the indicia defines the N consecutive bits, said translating means including code generator means, first and second counter means, comparator means, and initialization means, means clocking said code generator means at a predetermined rate to provide the digital code defined by the indicia, and means clocking said first counter means in synchronism with said code generator means to provide an output count from said first counter means which indicates where the code being produced, at any instant, by the code generator means is located relative to the start and finish of the digital code, said comparator means providing an equality signal when the code generator is at the location of the digital code indicated by the signal from the sensing means, said initialization means providing a signal which forces the second counter means to the count of the first counter means in response to at least one predetermined condition when the equality signal is provided by said comparator means.

4. The position measurement apparatus of claim 3 including reset means providing a signal when the position measurement apparatus is activated, and wherein the at least one predetermined condition to which the initialization means is responsive to force the second counter means to the count of the first counter means when the equality signal is provided by the comparator means, is the signal from said reset means.

5. The position measurement apparatus of claim 3 wherein the sensing means provides a direction signal indicative of the direction of the movable member relative to the travel path, and an index signal responsive to each bit of the first digital code sensed, with the second counter means being clocked by said index signals in a direction responsive to said direction signal.

6. The position measurement apparatus of claim 3 wherein the sensing means reads the indicia serially and including first and second storage means for storing at least the last N bits of the digital code read by the sensing means, and the digital code provided by the code generator means, respectively, with the comparator means comparing N consecutive bits of said first storage means with N consecutive bits of said second storage means.

7. The position measurement apparatus of claim 6 including reset means providing a signal when the position measurement apparatus is activated, and start means responsive to the reset signal which provides a signal when relative movement between the movable member and the indicia stores N bits in the first storage means, and wherein the at least one predetermined condition to which the initialization means is responsive to force the second counter means to the count of the first counter means when the equality signal is provided by the comparator means, is the signal from the start means.

8. The position measurement apparatus of claim 1 wherein the sensing means reads the indicia serially, and wherein the sensing means includes storage means for storing at least the last N bits of the digital code read, and providing signals for the translating means responsive to the N consecutive bits stored in said storage means.

9. Position measurement apparatus for determining the position of a movable member along a travel path, comprising:

a plurality of indicia, said indicia defining first and second similar digital codes, said indicia defining the first and second digital codes alternating with one another in a predetermined manner, said digital codes having a non-repeating bit pattern over any N consecutive bits thereof, sensing means responsive to said indicia, said sensing means and said indicia being arranged for relative movement responsive to movement of the movable member, said sensing means providing signals indicative of N consecutive bits of the first digital code defined by said indicia, said sensing means reading the indicia defining the digital codes serially, shift register means having first and second ends for storing at least the last N bits read by said sensing means, said sensing means providing signals in response to the first digital code when the movable member is moving in a first direction, which signals are introduced into the first end of the shift register means, said sensing means providing signals in response to the second digital code when the movable member is moving in the opposite direction, which signals are introduced into the second end of the shift register means, and translating means responsive to the signals provided by said sensing means, said translating means determining the position in the first digital code of the N consecutive bits indicated by the signals from said sensing means, and the location in the travel path where the indicia defines the N consecutive bits.

10. The position measurement apparatus of claim 1, wherein the first digital code is a maximum length code having a maximum bit length of $2^N - 1$.

11. Position measurement apparatus for an elevator system, for determining the position of an elevator car along a predetermined travel path, comprising:

a plurality of indicia defining the bits of first and second similar digital codes, said first and second digital codes each having a non-repeating pattern over N consecutive bits thereof, the bits of said first and second digital codes alternating with one another in a predetermined manner, sensing means responsive to said indicia, said sensing means and said indicia being arranged for relative movement responsive to movement of the elevator car, said sensing means including first and second spaced sensors which provide signals indicative of the bits of said first and second digital codes, respectively, as the elevator car moves along its travel path, direction means providing a signal indicative of the direction of travel of the elevator car along the travel path, shift storage means having first and second ends and at least N bits of storage capacity, said shift storage means being responsive to said sensing means and said direction means, with signals from said first sensor being introduced into the first end of said shift storage means and shifted towards the second end when the elevator car is moving in a first direction, and with signals from said second sensor being introduced into the second end of said shift storage means and shifted towards the first end when the elevator car is moving in a second direction, providing in the shift storage means a single digital code from the first and second digital codes, which single digital code effectively extends along the travel path of the elevator car, and translating means responsive to N consecutive bits of said shift storage means, determining the position in the single digital code of the bit pattern appearing in said shift storage means, and the corresponding location in the travel path represented by the indicia which defines this bit pattern.

12. The position measurement apparatus of claim 11 wherein the translating means includes code generator means, first and second counter means, and comparator means, means clocking said code generator means to provide, at a predetermined rate, the single digital code produced in the shift storage means, means clocking said first counter means in synchronism with said code generator means to provide an output count from said first counter means which indicates where the code being produced at any instant by the code generator means is located relative to the start and finish of the digital code, said comparator means providing an equality signal when the code generator is at the location of the digital code indicated by the bit pattern provided by N consecutive bits of the shift storage means, said second counter being forced to the count of the first counter means when the equality signal is provided by said comparator means.

13. The position measurement apparatus of claim 11 wherein the translating means includes code generator means first and second counter means, comparator means, and initialization means, means clocking said code generator means to provide, the single digital code produced in the shift storage means, means clocking said first counter means in synchronism with said code generator means to provide an output count from said first counter means which indicates where the code being produced at any instant, by the code generator means is located relative to the start and finish of the digital code, said comparator means providing an equality signal when the code generator is at the location of the digital code indicated by the bit pattern provided by N consecutive bits of the shift storage means, said initialization means providing a signal which forces the second counter means to the count of the first counter means in response to at least one predetermined condition when the equality signal is provided by said comparator means.

14. The position measurement apparatus of claim 13 including reset means providing a signal when the position measurement apparatus is activated, and wherein the at least one predetermined condition to which the initialization means is responsive to force the second counter means to the count of the first counter means when the equality signal is provided by the comparator means, is the signal from said reset means.

15. The position measurement apparatus of claim 13 wherein the sensing means provides an index signal each time data is introduced into the shift storage means, with the second counter means being clocked by said index signals in a direction responsive to the direction signal from the direction means.

16. The position measurement apparatus of claim 13 including storage means for storing at least N bits of the digital code generated by the code generator means, with the comparator means comparing N consecutive bits of the shift storage means with N consecutive bits of the storage means which stores the bits of the code generator means.

17. The position measurement apparatus of claim 16 including reset means providing a reset signal when the position measurement apparatus is activated, and start means responsive to the reset signal which provides a signal when the elevator car is moved sufficiently to store N bits in the shift storage means, and wherein the at least one predetermined condition to which the initialization means is responsive to force the second counter means to the count of the first counter means when the equality signal is provided by the comparator means, is the signal from the start means.

18. The position measurement apparatus of claim 11 wherein the sensing means includes third and fourth sensors and the indicia is arranged such that when the first sensor is reading a bit of the first or second digital codes the third sensor is reading the inverse of this bit, when the second sensor is reading a bit of the first or second digital codes the fourth sensor is reading the inverse of this bit, and wherein the indicia further defines first like code spacing bits, and second like code spacing bits which are the inverse of the first like code spacing bits, such that when the first sensor is reading a bit of the digital code, the second and fourth sensors are reading first like code spacing bits, when the first sensor is reading a bit of the second digital code the second and fourth sensors are reading second like code spacing bits, when the second sensor is reading a bit of the second digital code the first and third sensors are reading first like code spacing bits, and when the second sensor is reading a bit of the first digital code the first and third sensors are reading second like code spacing bits.

19. The position measurement apparatus of claim 18 wherein the direction means is responsive to which sensors read code spacing bits, and whether they read first or second like code spacing bits, on two successive readings of indicia, to determine the travel direction of the elevator car.

20. The position measurement apparatus of claim 11 wherein the plurality of indicia includes a tape having openings and blanks at predetermined locations thereof to indicate the appropriate bits of the first and second digital codes.

21. The position measurement apparatus of claim 11 wherein the bits of the digital code are defined by indicia which incidate a pair of unlike bits, and the spacings between adjacent bits of digital code are defined by pairs of like bits, with like bits of a first kind alternating with like bits of the opposite kind, and with the sensing means including third and fourth sensors which cooperate with the first and second sensors, respectively, in reading the pairs of bits.

22. The position measurement apparatus of claim 21 wherein the direction means is responsive to which sensors read like code spacing bits, and the kind of like bits read, on two successive readings of indicia, to determine travel direrction of the elevator car.

23. The position measurement apparatus of claim 11 wherein the first and second digital codes are maximum length codes, each having a maximum bit length of $2^N - 1$.

24. Position measurement apparatus for determining the position of a movable member along a travel path comprising:

a plurality of spaced indicia defining the bits of a digital code, with the bits of the digital code defining a non-repeating pattern over any N consecutive bits thereof, over the length of the spaced indicia, sensing means, said indicia and said sensing means being arranged for relative movement responsive to movement of said movable member, with said sensing means providing signals responsive to said indicia, storage means responsive to said sensing means for storing at least N bits of said digital code, with said sensing means updating said storage means in synchronism with movement of the movable member, and translating means responsive to the pattern of N consecutive bits in said storage means, said translating means determining the position in the digital code of the N consecutive bits in said storage means, and the location along the travel path which corresponds to this code location.

25. The position measurement apparatus of claim 24 wherein the digital code is a maximum length code having a maximum bit length of $2^N - 1$.

* * * * *